United States Patent [19]

Cimochowski et al.

[11] 4,439,175

[45] Mar. 27, 1984

[54] APPARATUS FOR FORMING THERMAL INSULATION BLOCKS

[75] Inventors: Anthony E. Cimochowski, Sedalia; Brad A. Heffelmire, Littleton, both of Colo.

[73] Assignee: Manville Service Corporation, Denver, Colo.

[21] Appl. No.: 311,104

[22] Filed: Oct. 13, 1981

[51] Int. Cl.[3] ..... B31D 5/04; B65H 45/20

[52] U.S. Cl. ..... 493/413; 493/437; 493/451

[58] Field of Search ..... 493/413, 411, 410, 440, 493/439, 437, 448, 451, 416

[56] References Cited

U.S. PATENT DOCUMENTS

| | | | |
|---|---|---|---|
| 980,385 | 1/1911 | Wollheim | 493/413 |
| 2,216,655 | 10/1940 | Smith et al. | 493/413 |
| 3,697,062 | 10/1972 | Mones et al. | 493/413 X |
| 4,001,996 | 1/1977 | Byrd, Jr. | 52/509 |
| 4,218,962 | 8/1980 | Cunningham et al. | 493/416 X |

FOREIGN PATENT DOCUMENTS

| | | | |
|---|---|---|---|
| 70361 | 11/1915 | Austria | 493/411 |
| 549752 | 12/1957 | Canada | 493/413 |
| 52560 | 10/1911 | Fed. Rep. of Germany | 493/413 |
| 918698 | 2/1963 | United Kingdom | 493/413 |

*Primary Examiner*—James F. Coan

*Attorney, Agent, or Firm*—Ronald M. Halvorsen; Richard K. Thomson

[57] ABSTRACT

A machine for forming blocks of fibrous insulation from a continuous fibrous blanket. These folded blocks may be used in furnace linings or the like. A pair of oscillating folder vanes form folds which extend in alternating directions. The vanes are oscillated by a continuously driven motor through a crank linkage. A reciprocating support vane engages the newly formed folds and supports them while the folder vanes are being disengaged from the blanket. A feeder drum and bearing member co-act to form a material supply loop from which the folds are made. The same motor drives all moving parts making the controls simple and inexpensive.

12 Claims, 11 Drawing Figures

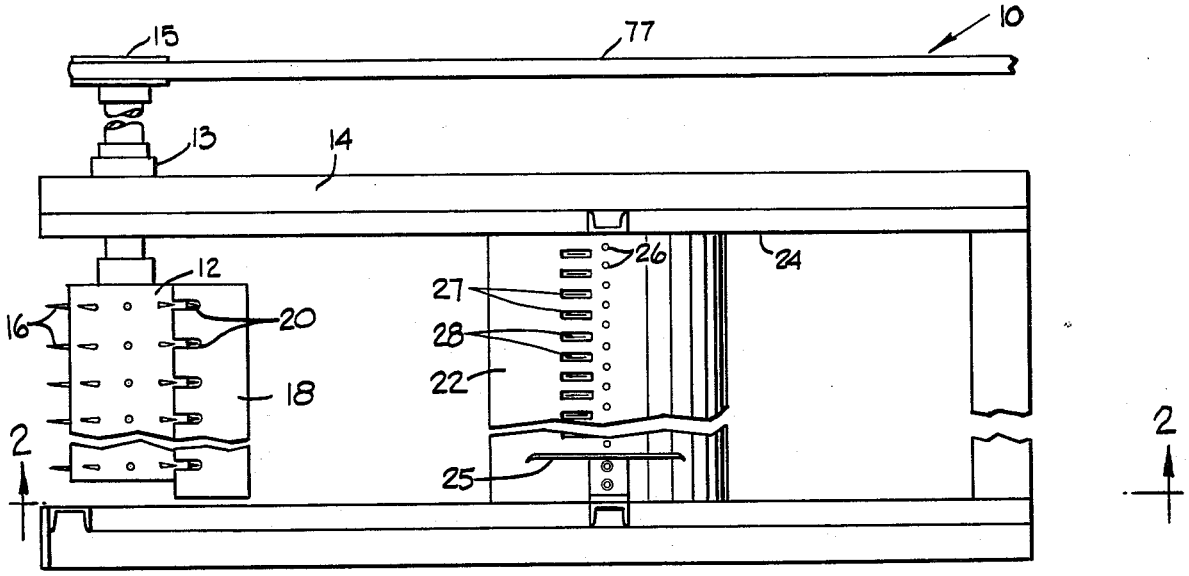
FIG. 1.
FIG. 2A.
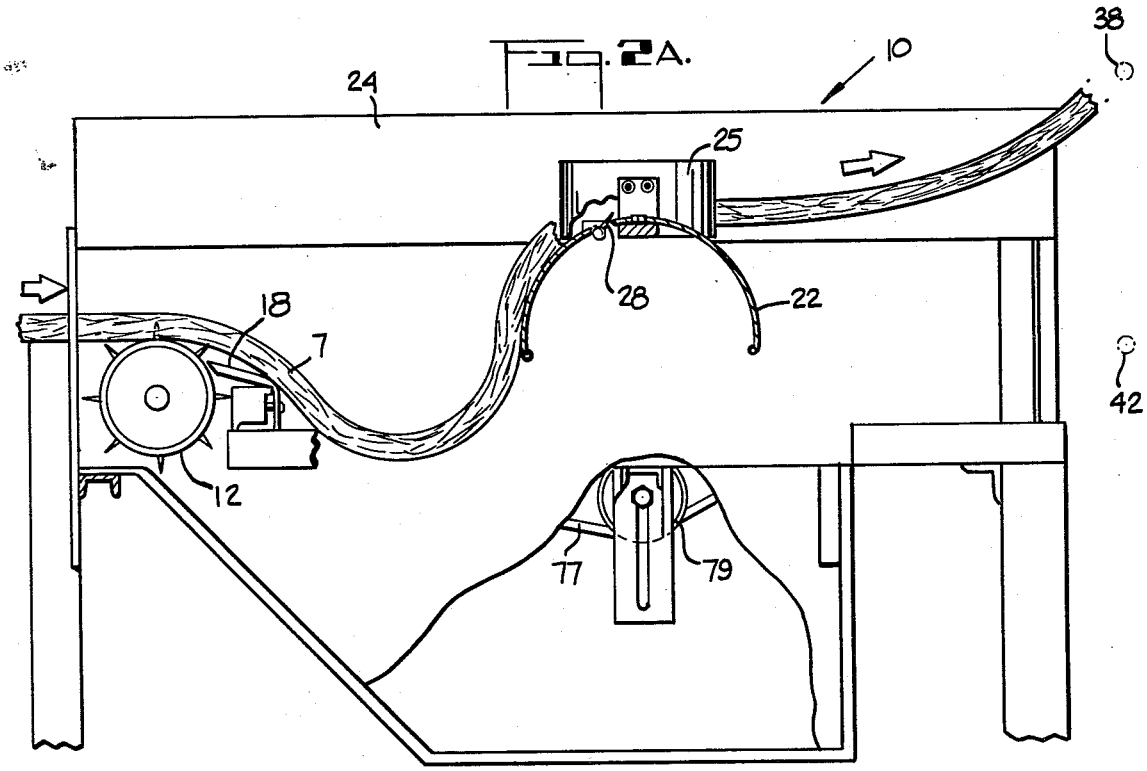
FIG. 6.
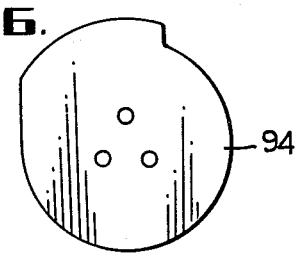

30
36
38
46
7
40
55
42
44
32
92
48
54
34

FIG. 3.
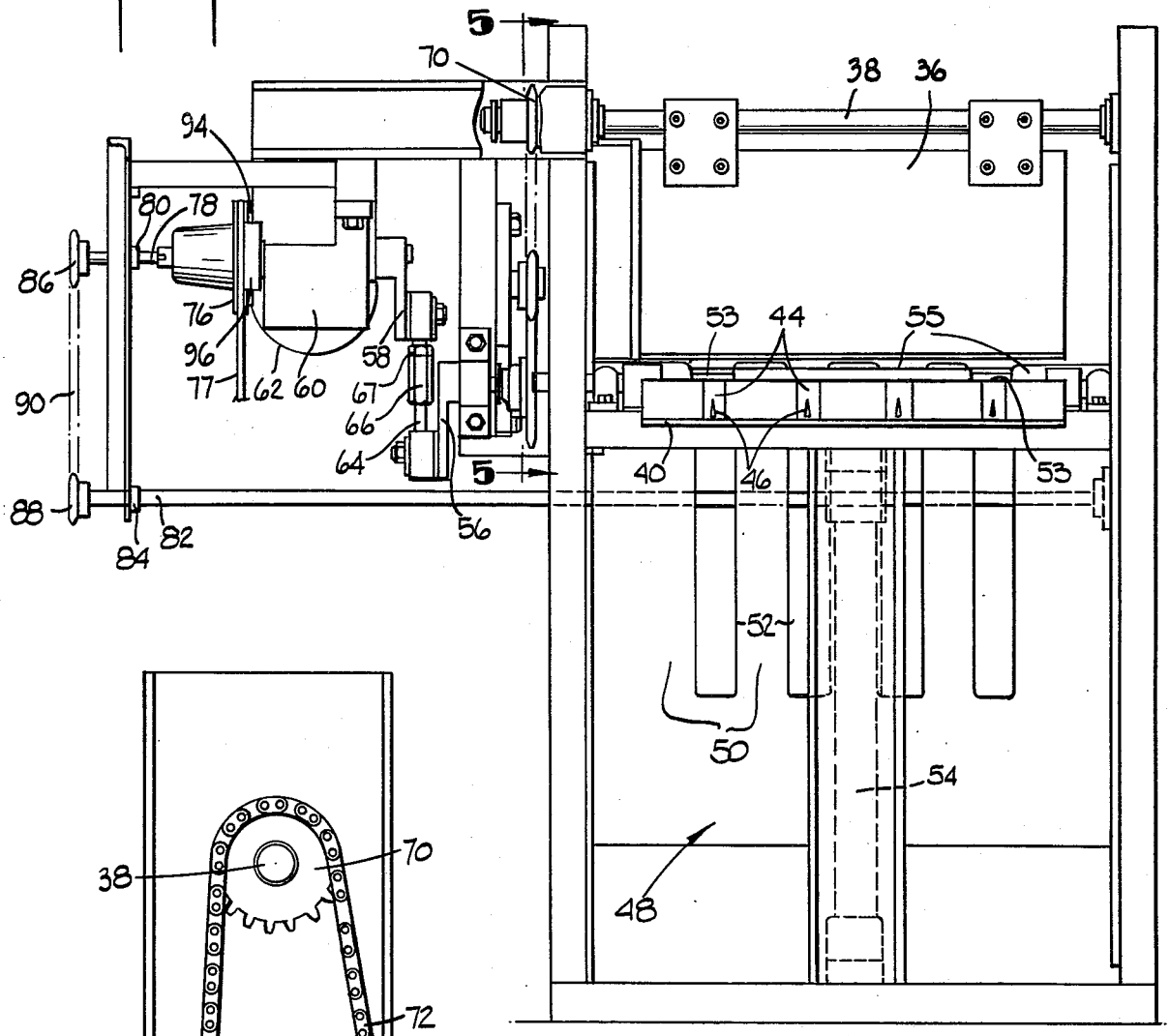
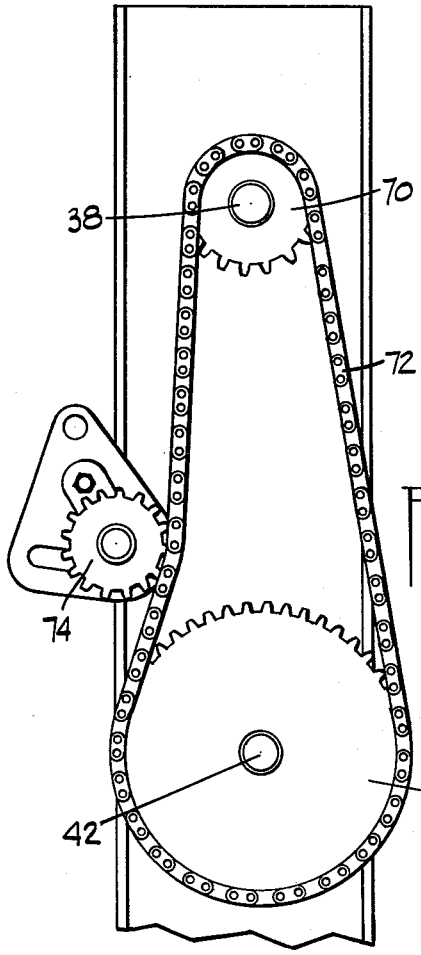
FIG. 5.
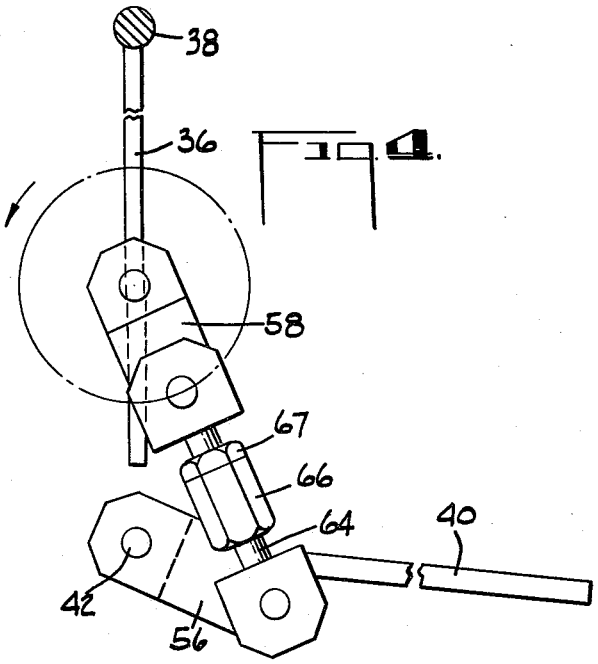
FIG. 4.

APPARATUS FOR FORMING THERMAL INSULATION BLOCKS

TECHNICAL FIELD

The present invention is directed to an apparatus for forming blocks of folded fibrous material. More particularly, the present invention is directed to an improved and simplified machine for folding a fibrous insulative blanket into modular blocks of insulation of the type used in furnace linings.

BACKGROUND AND SUMMARY OF THE INVENTION

The apparatus of the present invention is useful in the forming of blocks of folded fibrous material. More particularly, the apparatus of the present invention can be utilized in forming insulative blocks of the type disclosed in U.S. Pat. No. 4,001,996. These blocks, which are manufactured from blankets of refractory fibers, are extremely effective insulators for lining high temperature furnaces and the like.

The present invention comprises an improvement and simplification over the machine disclosed and claimed in U.S. Pat. No. 4,218,962 to Richard Cunningham et al. The mechanism disclosed in said patent manufactures blocks of folded fibrous material using upper and lower folding vanes. These vanes perform compound reciprocatory and oscillatory motions in creating the folds so as to fully support the blanket throughout the cycle. These compound motions require complicated support structure and, with the machine's capability of selectively and automatically inserting mounting supports, these compound motions require highly complex and sophisticated circuitry and switching means for proper sequencing. All of these complexities serve to escalate the cost of manufacturing such a machine.

The apparatus of the present invention eliminates the complicated, compound motions and the associated complex structure necessitated by the Cunningham et al. device. The upper and lower folder vanes are supported for simple rotational oscillatory motions which alternately engage the blanket, driven by a continuously driven electric motor to produce the folds. A reciprocating support vane engages the fibrous material and holds the formed folds during retraction of the two folder vanes. This simplified structure, in conjunction with the elimination of the mounting-support-inserting function, enables the sophisticated circuitry and switching means to be eliminated. The present machine can perform all of the same functions (with the exception of the support insertion aforementioned) as the Cunningham et al. device, with greater versatility. In addition, this machine has a higher reliability because of its simplicity and can be manufactured for about ⅓ the cost of the previous machine.

Various other features, advantages and characteristics of the present machine will become apparent after a reading of the following specification.

BRIEF DESCRIPTION OF THE DRAWING

FIG. 1 is a plan view of the feeder unit of the present invention;

FIG. 2A is a cross sectional side view of the feeder mechanism of the present invention as seen along line 2—2 in FIG. 1;

FIG. 3 is an end view of the folder section as seen from the feeder section;

FIG. 4 is a schematic side view of the oscillating crank linkage;

FIG. 5 is a detail of the drive connection between the two folder vanes as seen along line 5—5 in FIG. 3;

FIG. 6 is a side view detail of the cam which controls the vertical position of the support vane;

DETAILED DESCRIPTION OF THE PREFERRED EMBODIMENTS

Figure 2B:
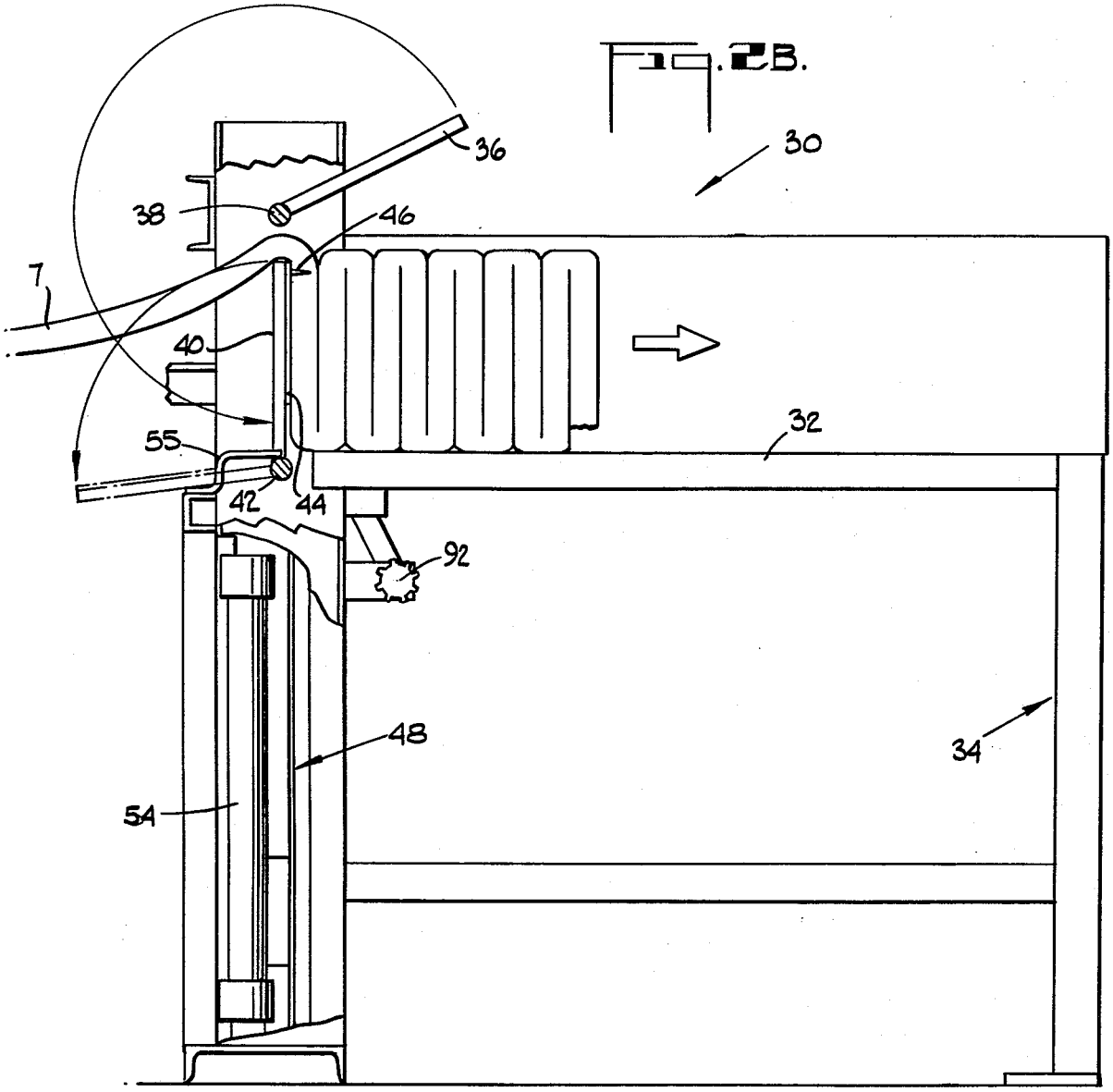
FIG. 2B is a side view of the folder apparatus of the present invention with parts broken away.

The apparatus of the present invention comprises a feeder section 10 and a folder section 30 seen in FIGS. 2A and 2B, respectively. Although depicted separately as a matter of convenience, feeder section 10 and folder section 30 are designed to operate as a unit and could just as well be mounted on a single frame.

Folder section 30 comprises a planar support member 32 which is mounted on frame 34. A first folder vane 36 is mounted on shaft 38. Shaft 38 is journaled in frame 34 for rotation about a generally fixed axis adjacent the upper face of support member 32. A second folder vane 40 is mounted on a shaft 42 which is similarly journaled in frame 34 for rotation about a second generally fixed axis, this axis being positioned adjacent the lower face of support member 32. A plurality of protrusions, in the form of plates 44, are attached to the material engaging surface of folder vane 40. At least one of the plates 44 and, preferably, each of them, has a material-penetrating needle 46 positioned adjacent one end for purposes which will be discussed more fully hereafter.

Beneath and adjacent support member 32 is a reciprocable support vane 48. Since in simplifying the machine of the present invention from the Cunningham et al. device, the compound motion of the folder vanes has been eliminated, there are times when the folded material is not contacted by either of the folder vanes 36 or 40. This is necessary in order to permit one vane to clear the folding zone prior to the entry into the zone, and formation of the next successive fold by, the other folding vane. If totally unsupported during these transition periods, some portion or all of the most recently formed fold might slip out or fall over. It is the function of support vane 48 to maintain the integrity of the folds and prevent such slippage.

Support vane 48 comprises a plurality of longitudinally extending fingers 50 (FIG. 3) whose spaces 52 permit fingers 50 to interdigitate with plates 44. The fingers 50 have substantially the same thickness as plates 44. Spaces 52 have a depth sufficient to enable support vane 48 to reciprocate vertically through its full stroke without contacting plates 44. A rodless air cylinder 54 is connected to support vane 48 to move it between its two operational positions. It is preferred that cylinder 54 be rodless since it substantially reduces the space which must be afforded the support vane 48 and its reciprocator and, hence, substantially reduces the height of the folder section to a comfortable level for the operator. An arcuate support plate 55 curves around shaft 42 and extends the width of the folder vane. Plate 55 is relieved at the two points 52 (FIG. 3) where folder vane 40 connects to shaft 42. The plate 55 is positioned at the same level as support 32, extends through the space between vane 40 and shaft 42, and prevents sagging of the folds during portions of the folding cycle (FIGS. 7C and 7D).

The Cunningham et al. device described in the aforementioned U.S. Pat. No. 4,218,962 was designed to accommodate a 12 inch width of material. However, the present machine can handle widths up to 24 inches. Accordingly, allowing the folder vanes to feed the material themselves is no longer practical. The wider, heavier material rolls can provide a substantial drag on the feeding operation. This drag generally decreases as the roll is paid out. Hence, the initial folds are shorter due to the tension in the blanket, resulting in folded blocks of varying fold height.

In order to improve product consistency, feeder section 10 is provided (FIG. 2A). Feeder 10 comprises a rotary drum 12 mounted by bearing block 13 on frame 14. A split pulley 15 by which drum 12 is driven is positioned outboard of frame 14. A plurality of rows of spikes 16 project from the drum for penetrating and advancing a blanket or strip of material 7. A stripper plate 18 is positioned adjacent drum 12 to insure that the strip disengages from spikes 16. Stripper plate 18 has a plurality of clearance slots 20 to permit passage of the spikes. Positioned intermediate drum 12 and folder section 30 is a semi-cylindrical bearing member 22 which supports the blanket.

A first lateral guide 24 extends along the frame 14. A second lateral guide 25 is adjustably mounted on bearing member 22 using holes 26. Guide 25 can be adjusted to accommodate any of a number of various blanket widths up to a maximum of 24 inches. A series of slots 27 are positioned upstream of holes 26. These slots 27 enable a plurality of pins 28 to extend upwardly to positions above the surface of bearing member 22. These pins are slanted slightly in the material-advancing direction and, due to their flexibility, will generally bend an even greater amount in that direction under the weight of blanket 7. However, should the blanket 7 tend to move in the back-feed direction (i.e., toward drum 12), pins 28 will penetrate the blanket and prevent such slippage.

The drive means for the various components of the present invention are best seen in FIGS. 3–5. Fixedly attached to shaft 42 of folder vane 40 is a crank 56. A second crank 58 is fixedly attached to the output of gear reducer 60 of motor 62. Cranks 56 and 58 are interconnected by link 64. Link 64 is pivotally interconnected at each of its ends to one of the cranks. An adjustment nut 66 permits adjustment of the length of link 64 and, hence, adjustment of the end points of the oscillation of folder vane 40. Nut 67 locks adjustment nut 66 against undesired position. Crank 58 is rotated by motor 62 through gear reducer 60 which transmits an oscillatory motion to folder vane 40 through link 64 and crank 56. Preferably, this oscillatory motion is through an 100° arc from vertical which will be sufficient to bring needles 46 below the path of material blanket 7.

A sprocket 68 is fixedly attached to shaft 42 and a smaller sprocket 70 is fixedly connected to shaft 38. These sprockets are interconnected by chain 72. The size and tooth ratios are selected such that shaft 38 will travel approximately 2½ times as far as shaft 42. That is, folder vane 36 will travel through an arc of about 250° as opposed to the 100° arc of folder vane 40. Since these movements must be accomplished in equal amounts of time, vane 36 travels at generally 2½ times the rotational speed of vane 40. These movements are sequenced so that vanes 36 and 40 will alternately engage the blanket in the folding zone. Idler sprocket or roller 74 is adjusted so as to keep chain 72 taut.

The opposite side of gear reducer 60 drives a variable pitch pulley 76. Pulley 76, in turn, drives a V-belt 77 which is wrapped around drum-drive pulley 15. Threaded shaft 78 is threadingly engaged by nut 80 mounted on frame 34. A second elongated shaft 82 is threadingly engaged by nut 84 also mounted on frame 34. Sprockets 86 and 88 are fixedly attached to shafts 78 and 82 respectively. A chain 90 interconnects the sprockets 86 and 88. The extension of shaft 82 has a knob 92 thereon enabling the operator to make adjustments from the opposite or unencumbered side of the machine. Rotation of knob 92 causes threaded shaft 82 to cause sprocket 88 to move axially relative to nut 84 and frame 34. A similar translation of shaft 78 takes place due to the interconnection of sprockets 86 and 88 by chain 90. This axial translation varies the pitch of pulley 76 by opening or closing the space between the pulley halves and varying the place of engagement of V-belt 77. This changes the rate of rotation of drive drum 12 and, accordingly, the rate at which material is delivered to folder 30. The halves of the pulley 15 mounted on the drum shaft are spring-biased and open and close in response to the adjustments made to variable pitch pulley 76. Slack produced by such movement is taken up by tensioning roller 79.

Also mounted on this side of gear reducer 60 is a cam 94 and an air valve 96. The cam 94, whose peripheral configuration is depicted in FIG. 6, operates air valve 96 which, in turn, controls the flow of air to cylinder 54. Cam 94 is configured such that cylinder 54 and support vane 48 will be in the extended position for approximately ¾ of the cam cycle (which corresponds to ¾ of the operational folding cycle) and is withdrawn for the remaining ¼ of the cycle.

Figure 7A:
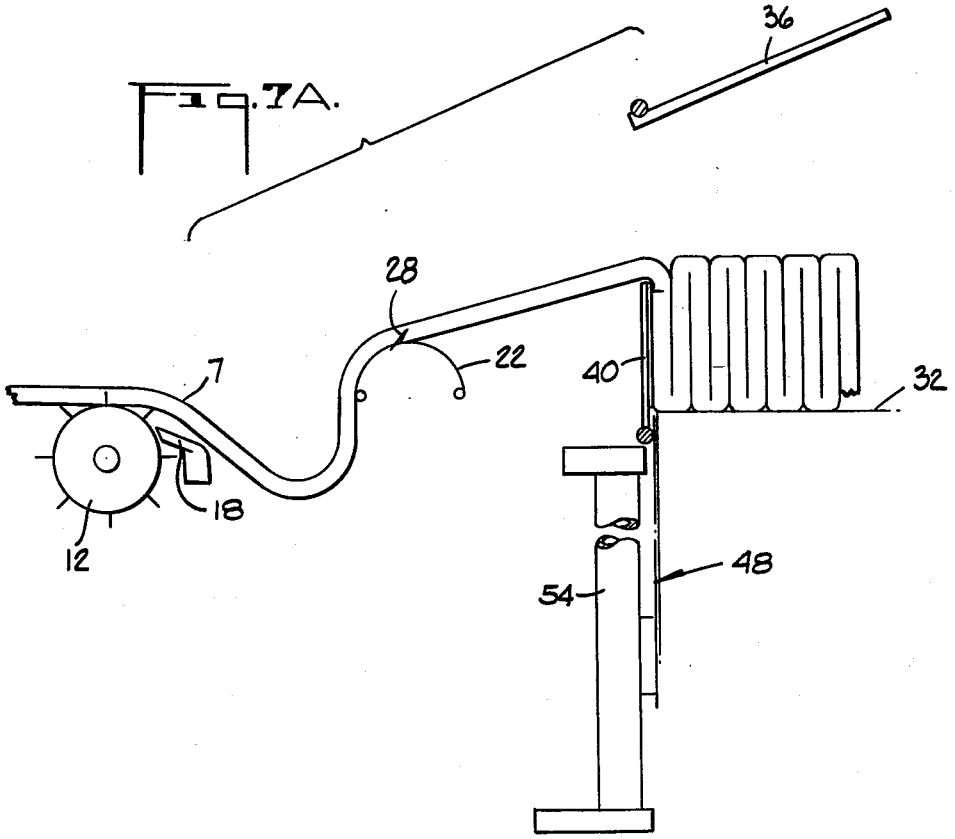
FIGS. 7A, 7B, 7C and 7D are schematics of the sequential operations of the apparatus of the present invention.
Figure 7B:
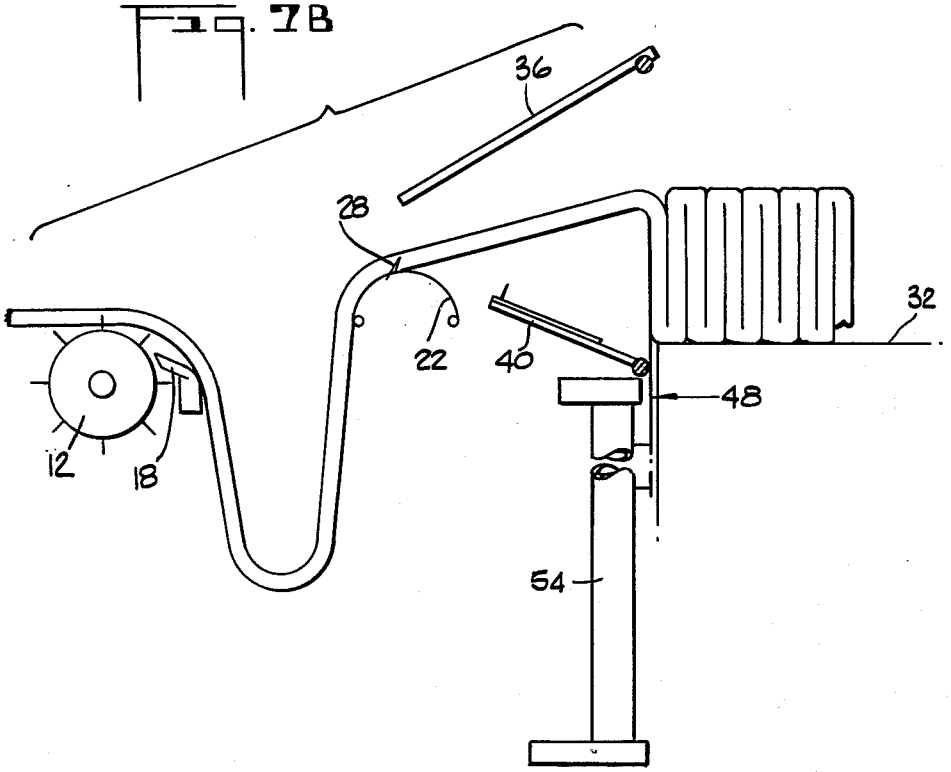
Figure 7C:
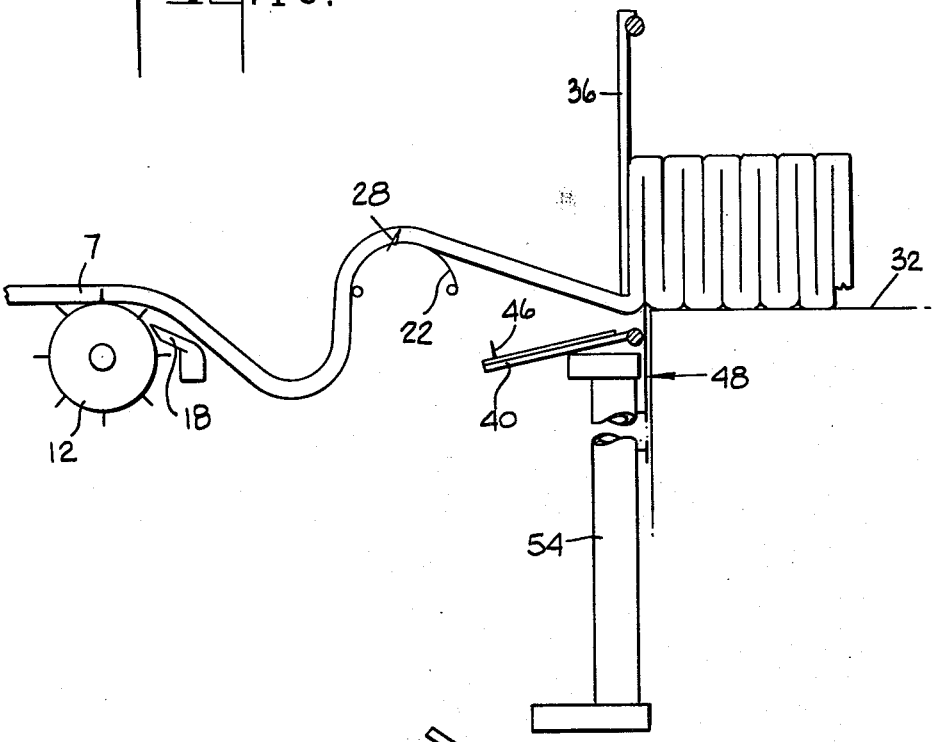
Figure 7D:
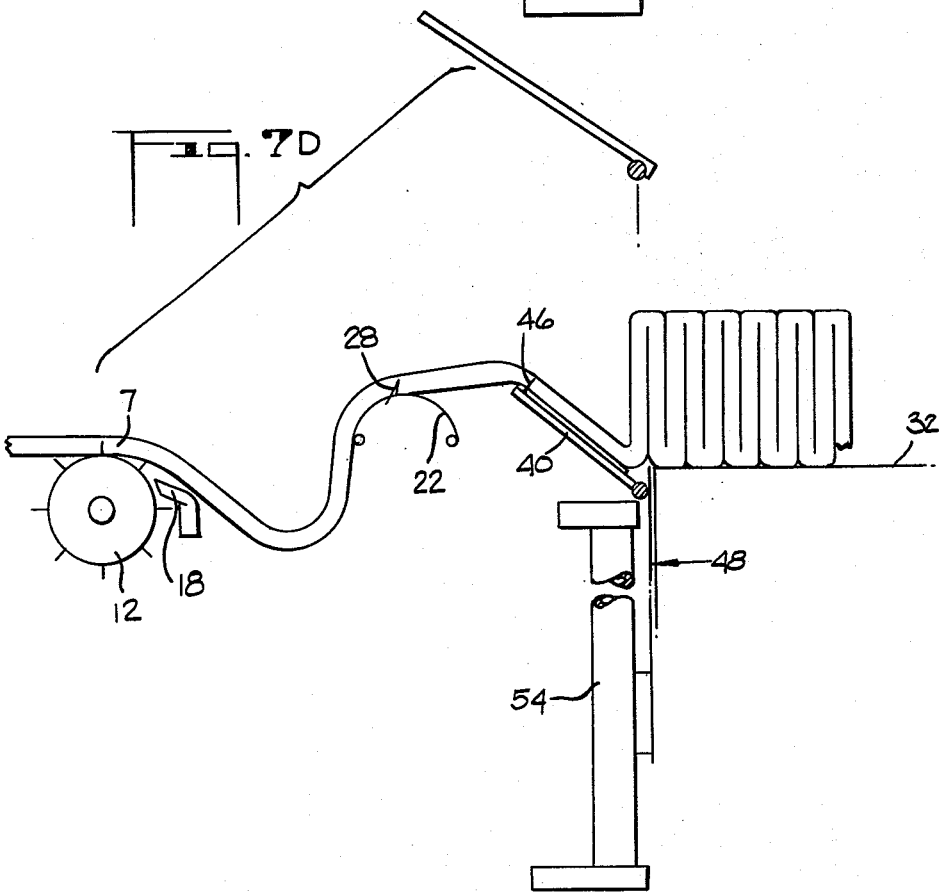

The overall machine operation will be best understood by referring to FIGS. 7A–D. As seen in FIG. 7A, lower feeder vane 40 has just completed its fold by deflecting the material of blanket 7 so that it extends in a direction away from the upper face of support member 32. In completing this fold, vane 40 pushes the folded block along support member 32 by an amount generally equal to twice the material thickness. Immediately following vane 40 reaching this position, cam 94 triggers air valve 96 causing cylinder 54 to elevate support vane 48. Fingers 50 fit between plates 44 on the material-engaging face of folder vane 40 so as not to disturb the position of the material.

The folds are fully supported at this point and folder vane 40 may be oscillated out of the folding zone preparatory to the arrival of folder vane 36. This withdrawal takes place as a result of the continuous rotation of crank 58 by motor 62 through reducer 60. There are momentary pauses or dwells at the end points of the oscillators of vanes 36 and 40 which are characteristic of such crank mechanisms. These dwells facilitate the insertion of the support vane. As shown in FIG. 7B, folder vane 40 has been retracted from the folding zone and folder vane 36 is just about to engage blanket 7. At this point, the material loop between feed drum 12 and bearing member 22 is at its maximum length due to the continuous rotation of drum 12. This loop may be of any desired length, so long as there is sufficient material accumulation to supply the length of the next fold.

As shown in FIG. 7C, folder vane 36 has completed its fold by deflecting the blanket 7 in a direction back toward the plane of the upper face of support member 32. Support vane 48 has remained in its extended position and blanket 7 is folded about it. As folder vane 36 is oscillated out of the folding zone, the weight of the loop between drum 12 and bearing member 22 would cause the fold to be partially undone, were it not for the engagement of the blanket by pins 28.

As shown in FIG. 7D, folder vane 40 has begun its upward movement once again. Needles 46 have penetrated blanket 7 thus insuring that a proper amount of material will be present to form the next fold. At this point, cam 94 actuates air valve 96 causing support vane 48 to be retracted so that on completion of the fold, folder vane 40 may once again index the completed block by an amount generally equal to twice the thickness of the blanket 7.

Should it be desired to make a block of greater of lesser height, it is only necessary to replace folder vanes 36 and 40 and support vane 48 with longer or shorter vanes. As already noted, the lateral guides may be adjusted to accommodate different material and block widths. A horizontal support plate (not shown) of the type used in U.S. Pat. No. 4,218,962 may be employed above the block if desired. While on support member 32, the blocks will be severed from the continuous folded member. After thus being cut to the desired size, the mounting supports can be inserted by hand and the blocks bound in accordance with the teachings of the aforementioned patent.

Various changes, alternatives and modifications will become apparent to those of ordinary skill in the art following a reading of the foregoing specification. For example, the ratio of the arc lengths of folder vanes 40 and 36 might very well be varied to 2 to 1. Accordingly, it is intended that all such changes, alternatives and modifications as come within the scope of the appended claims be considered part of the present invention.

We claim:

1. Apparatus for forming blocks of folded fibrous materials comprising:

(a) a planar support member having first and second faces;

(b) means for feeding a strip of fibrous material in a direction generally aligned with the first face of said planar support member;

(c) a first folder vane which rotationally oscillates about a first generally fixed axis that is positioned adjacent the first face of said support member, said first folder vane engaging said strip of fibrous material and creating a fold therein by deflecting the material so that it extends toward said first face;

(d) a second folder vane which rotationally oscillates about a second generally fixed axis that is positioned adjacent the second face of said support member, said second vane engaging said strip of fibrous material and creating a fold therein by deflecting the material so that it extends away from said first face, said first and second folder vanes alternating to form a block of folded fibrous material with a centerline intermediate said folds;

(e) a support vane which reciprocates in a plane that is generally perpendicular to said planar support member between a first position in which the support vane is in a material non-engaging position on one side of the block's centerline and a second position where at least a portion of said support vane extends to the other side of the block's centerline into engagement with said fibrous material to support said previously formed folds when the first and second folder vanes are being disengaged therefrom.

2. The apparatus of claim 1 wherein the planar support surface lies in a generally horizontal plane.

3. The apparatus of claim 1 wherein said second folder vane has at least one needle projecting from its material-engaging surface to insure that a proper length of fibrous material is formed into each fold formed thereby.

4. The apparatus of claim 1 wherein said means for feeding the strip of fibrous material comprises a rotationally driven spiked drum.

5. The apparatus of claim 4 wherein said means for feeding the strip of fibrous material further comprises a generally semi-cylindrical bearing member positioned between said spiked drum and said planar support member for supporting said fibrous strip.

6. The apparatus of claim 5 wherein said spiked drum is rotationally driven at a generally constant speed creating a material supply loop between said drum and said cylindrical bearing member.

7. The apparatus of claim 5 wherein strip-engaging pins project through slots in said semi-cylindrical bearing surface, said pins extending in a strip-advancing direction to prevent strip movement in a back-feed direction.

8. The apparatus of claim 5 further comprising a first lateral guide fixedly positioned adjacent one side of said feed drum and a second lateral guide mounted on said cylindrical bearing member.

9. The apparatus of claim 8 wherein said second lateral guide is adjustably mounted on said cylindrical bearing member so as to accommodate strips of fibrous material of various widths.

10. The apparatus of claim 1 wherein said second folder vane is oscillated through a rotational arc of substantially 100° by a linkage connected to a rotationally driven crank.

11. The apparatus of claim 10 wherein said first folder vane is oscillated through a rotational arc of substantially 250° by a chain and sprocket which is interconnected to said second folder vane.

12. The apparatus of claim 1 wherein said second folder vane has a plurality of spaced, longitudinally extending protrusions thereon and said support vane comprises a plurality of longitudinally extending fingers which can interdigitate with said protrusions.

* * * * *